US009162482B2

(12) United States Patent
Öhman

(10) Patent No.: US 9,162,482 B2
(45) Date of Patent: Oct. 20, 2015

(54) PRINTING SYSTEM, AND A METHOD FOR PRINTING

(71) Applicant: Tetra Laval Holdings & Finance S.A., Pully (CH)

(72) Inventor: Peter Öhman, Lund (SE)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 0 days.

(21) Appl. No.: 14/382,934

(22) PCT Filed: Feb. 20, 2013

(86) PCT No.: PCT/EP2013/053321
§ 371 (c)(1),
(2) Date: Sep. 4, 2014

(87) PCT Pub. No.: WO2013/131746
PCT Pub. Date: Sep. 12, 2013

(65) Prior Publication Data

US 2015/0049135 A1 Feb. 19, 2015

(30) Foreign Application Priority Data

Mar. 5, 2012 (SE) ..... 1250206

(51) Int. Cl.
*B41J 29/38* (2006.01)
*B41J 3/54* (2006.01)
*B41J 15/22* (2006.01)

(52) U.S. Cl.
CPC . *B41J 3/543* (2013.01); *B41J 15/22* (2013.01)

(58) Field of Classification Search
USPC ..... 347/9
See application file for complete search history.

(56) References Cited

U.S. PATENT DOCUMENTS

| | | | | |
|---|---|---|---|---|
| 3,597,071 | A * | 8/1971 | Jones | 399/203 |
| 2005/0156968 | A1* | 7/2005 | Silverbrook et al. | 347/13 |
| 2007/0076030 | A1* | 4/2007 | Izuo | 347/9 |
| 2008/0136856 | A1* | 6/2008 | Azami et al. | 347/16 |
| 2009/0278881 | A1* | 11/2009 | Furuya | 347/14 |

FOREIGN PATENT DOCUMENTS

CA 1 070 557 A2 1/1980

OTHER PUBLICATIONS

International Search Report (PCT/ISA/210) mailed on Jun. 5, 2013, by the European Patent Office as the International Searching Authority for International Application No. PCT/EP2013/053321.

* cited by examiner

*Primary Examiner* — Stephen Meier
*Assistant Examiner* — Alexander D Shenderov
(74) *Attorney, Agent, or Firm* — Buchanan Ingersoll & Rooney PC

(57) ABSTRACT

A printing system for printing a repeated pattern of esthetical and/or informative character on a substrate including a plurality of parallel webs is provided. The printing system comprises at least two overlapping non-impact printer units, each of which having a lateral elongation defining a maximum printing width, and a controller connected to each one of the printer units and configured to set an actual printing width extending between a start position and an end position of the lateral elongation, wherein the controller is configured to determine the actual printing width by receiving the lateral position of a non-printed area defined by the interface between two adjacent webs of the substrate and located laterally somewhere in the overlap between two printer units, such that the end position of a first printer unit and the start position of an overlapping printer unit is located within the non-printed area.

12 Claims, 2 Drawing Sheets

PRINTING SYSTEM, AND A METHOD FOR PRINTING

TECHNICAL FIELD

The present invention relates to a printing system. Further, the present invention relates to a printing system and a method for providing a repeated pattern of esthetical and/or informative character on a substrate including a plurality of parallel webs.

BACKGROUND

Different techniques for industrial printing on a paper-based material are well known. For some purposes it may be suitable to separate the known techniques into two categories, namely impact printing and non-impact printing.

Examples of impact printing techniques include flexography, rotogravure, and offset printing. Common for these examples is the requirement of a master image, often called a cliché, which is at least partially covered with ink in a pattern representing the image to be printed. The cliché is then pressed against a substrate to be printed, either directly or indirectly via one or several compression cylinders, in order to transfer the ink with high resolution to the substrate. The substrate may e.g. be paper, film, laminate, or board. Impact printers are typically implemented in large scale and high speed printing systems where static images need to be printed.

On the other hand, non-impact printing techniques do not require the printer to be in direct contact with the substrate to be printed. Inkjet printers, to mention one well known technique within this category, are thus arranged at a distance from the substrate and are controlled digitally thus being capable of providing high resolution dynamic images.

Within food packaging technology impact printing techniques are so far chosen due to their high speed and robust operation in providing high quality printing of static images. Large scale printing is conventionally performed by printers being up to 2 m wide, even though a final roll fed packaging system web width only is a part of the total width such that it is possible to print up to ten parallel webs simultaneously. Roll fed substrates are generally slitted to single webs at the finalization of the substrate production for later use as a packaging material in the filling equipment.

Nevertheless impact printer, used when printing e.g. a décor layer on a carton based material for later use as a packaging material in food packaging industry, require vast amount of resources. The production of the clichés is time consuming and costly, and is dependent on the use of expensive development chemicals. Further, clichés are usually fastened by means of adhesive tape which contributes to the rather high overall cost of such system when utilized in industrial mass production applications.

Hence, it would be advantageous to replace the impact printers with non-impact printers within the food packaging material production in order to reduce time and costs of the printing process, but also for allowing a rapid change of the image to be printed without the need for a shutdown and cliché exchange. However, since there is no easy way of providing sufficiently wide non-impact printers it would be necessary to arrange several printer units adjacent to each other in order to cover the complete paper. This would also require so called stitching, which is a complex algorithm for providing a seamless continuation of the printed image where two printer units overlap. Further, it would be required to apply a significant tension to the substrate in order to ensure the correct position of each part of the substrate. However, in case of thin substrates, such as paper etc., such tensioning would increase the risk of substrate damages, as well as a reduction in the printing quality since the printed pattern will be deformed once the tension is removed from the substrate. Since the human eye is extremely sensitive for detecting misalignment of image pixels it would thus be beneficial to provide a solution utilizing overlapping non-impact printer units in an efficient and robust manner.

SUMMARY

Accordingly, the present invention preferably seeks to mitigate, alleviate or eliminate one or more of the above-identified deficiencies in the art and disadvantages singly or in any combination and solves at least the above mentioned problems by providing a system according to the appended claims.

An idea of the invention is to control each one of the overlapping printer units, and to use the position of dedicated non-printed areas, provided between adjacent webs of the carton based material, when controlling the overlap of the printer units.

A further idea is to control a lateral operating width of each printer unit such that the overlap between two adjacent printer units occurs at the dedicated non-printed areas.

In food packaging material production non-printed areas are preferably provided along the longitudinal ends of the package blank or tube due to the fact that the blank or tube is sealed along this longitudinal end. Hence, there will be one hidden area on the roll fed substrate which thus is unnecessary to print, but printing on the inner sealing end may also affect the sealing properties negatively. Since the non-printed areas are always provided in the area between the webs of the paper roll these may be used when aligning several overlapping printing units.

According to a first aspect of the invention, a printing system for printing a repeated pattern of esthetical and/or informative character on a substrate including a plurality of parallel webs is provided. The printing system comprises at least two overlapping non-impact printer units, each of which having a lateral elongation defining a maximum printing width, and a controller connected to each one of said printer units and configured to set an actual printing width extending between a start position and an end position of said lateral elongation, wherein said controller is configured to determine said actual printing width by receiving the lateral position of a non-printed area defined by the interface between two adjacent webs of the substrate and located laterally somewhere in the overlap between two printer units, such that the end position of a first printer unit and the start position of an overlapping printer unit is located within the non-printed area.

The controller may be configured to receive the lateral positions of a plurality of non-printed areas, and further to select the lateral position of a single non-printed area being located somewhere in the overlap between two printer units.

The lateral position of the non-printed area received by the controller may be represented by a lateral distance extending from a first position and a second position, and the end position of the first printer unit may correspond to the first position of the non-printed area, and the start position of the overlapping printer unit may correspond to the second position of the non-printed area.

The maximum printing width of each printer unit may be less than 1000 mm, and the total printing width of the printing system may be above 1000 mm.

The width of each web of the substrate may be between 100 and 400 mm, and the width of the non-printed area may be between 5 and 50 mm.

Each printer unit may be an inkjet printer. Further, the substrate may be roll fed. The substrate may be a carton based material for later converting into a liquid food packaging material.

According to a second aspect, a printer is provided. The printer comprises a plurality of printing systems according to the first aspect arranged in series along a processing path of the printable substrate, wherein each printing system is configured to print a specific color and/or part of the repeated pattern on the printable substrate.

Each web of the printable substrate may be associated with a unique image to be printed, and the printing systems may be programmed to print the unique image on the corresponding web.

According to a third aspect, a method for providing a printing system configured to apply a repeated pattern of esthetical and/or informative character on a substrate including a plurality of parallel webs is provided. The method comprises the steps of providing at least two non-impact printer units in an overlapping arrangement, each of which having a lateral elongation defining a maximum printing width, and connecting a controller to each one of said printer units for determining an actual printing width of each one of said printer units, said actual printing width is extending between a start position and an end position of said lateral elongation, by i) receiving the lateral position of a non-printed area defined by the interface between two adjacent webs of the substrate and located laterally somewhere in the overlap between two printer units, and ii) determining the actual printing width of each one of the printer units such that the end position of a first printer unit and the start position of an overlapping printer unit is located within said non-printed area.

BRIEF DESCRIPTION OF DRAWINGS

These and other aspects, features and advantages of which the invention is capable of will be apparent and elucidated from the following description of embodiments of the present invention, reference being made to the accompanying drawings, in which.

DETAILED DESCRIPTION

Figure 1:
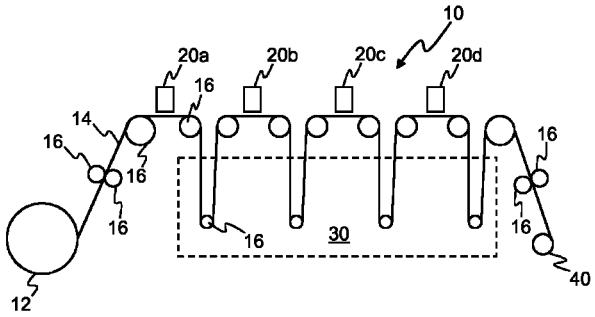
FIG. 1 is a schematic side view of a printer including several printing systems according to an embodiment.

With reference to FIG. 1 an industrial printer 10 according to an embodiment is shown. The printer 10 is thus constructed to provide a repeated pattern of esthetical and/or informative character, such as a décor layer or a functional pattern being related to traceability, on a substrate at high speed, such as above 100 m/min. The substrate may for this purpose be a carton based material later forming the core layer of a liquid food packaging material, and it may be printed at a speed of 200 m/min.

At the left end of the figure a substrate roll 12 is provided. The substrate roll may be a roll of carton based material suitable for later converting into a food packaging material, which then may be used in standard liquid food filling machines. The substrate includes a plurality of parallel webs, wherein the number of webs typically between 2 and 10. In case of later forming of 1 liter packages, a web is normally about 300 mm wide. Hence, the width of the substrate may typically be up to 2 m.

Upon rotation of the roll 12 the substrate 14 is continuously unwinded from the roll 12 and it may thus be transported through the printer 10. A number of cylinders 16 are provided along the transport path of the substrate for different purposes such as driving, braking, stretching, or guiding of the substrate during feeding.

The substrate passes through a first printing system 20*a* which includes a number of laterally aligned and overlapping non-impact printers. The array of printers included in the printing system 20*a* covers the entire width of the substrate 14 in order to print across the entire width of the substrate 14.

Each non-impact printer is controlled such that the image, printed by the non-impact printer, may be changed dynamically and in real time.

After passing through the first printing system 20*a* the substrate is fed through an optional drying section 30 for allowing the ink to dry before it is subsequently fed to a second printing system 20*b* arranged downstream of the first printing system 20*a*.

The second printing system 20*b* is identical with the first printing system 20*a* but for the associated color of the ink to be printed. A third and fourth printing system 20*c* and 20*d* are also provided such that each one of the printing systems 20*a-d* may be associated with one of the colors C, M, Y, or K. This kind of color representation, i.e. CMYK, is normally referred to as process printing.

After passing through the fourth printing system 20*d* and the subsequent optional dryer 30 the substrate is winded on a final roll 40. The final roll 40 may later be processed in a converting system where lamination and further materials are bonded to the substrate such that the converted material is suitable to form liquid food packages.

Figure 2:
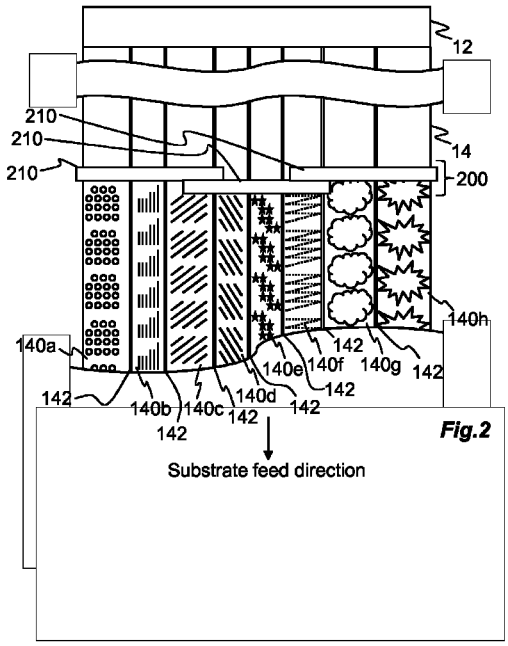
FIG. 2 is top view of a printing system according to an embodiment.

In FIG. 2 one of the printing systems 20*a-d* is shown in more detail and is here represented by the reference numeral 200. The printing system 200 is arranged in parallel with the feeding direction of the moving substrate 14 and extends from one lateral end of the substrate 14 to the opposite end of the substrate 14. Preferably, the printing system 200 is arranged perpendicular to the feeding direction of the substrate 14.

The printing system 200 includes several printer units 210 provided in an overlapping arrangement such that each printer unit 210 only covers a part of the width of substrate 14. Hence, in order to provide a décor layer on the entire width of the substrate 14 all of the printer units 210 must be activated.

As is shown in FIG. 2 the substrate 14 includes a plurality of webs 140*a-h*. Each web 140*a-h* has a width corresponding to the dimensions of a specific package which is to be formed later in a filling machine. In case where different packages from a single roll 12 of substrate 14 are desired, each web 140*a-h* will be printed with a unique image by the printing system 200. The number of webs 140*a-h* may be chosen freely, but may typically be in the range of 5 to 10. The width of a web 140*a-h* lies normally somewhere between 100 and 400 mm, and the total width of the substrate 14 is typically 1600 mm.

The webs 140*a-h* are arranged at distance from each other, wherein the distance is defined as a non-printed area 142 extending in the substrate feed direction. Preferably, the non-printed areas 142 have a constant width, but other shapes of the non-printed areas 142 are also possible. Generally, the exact shape of the non-printed areas 142 are dependent on the final package to be produced, since the non-printed areas 142 represent the shape and design of the longitudinal sealing of the packages later formed. Hence, the shape of the non-printed areas 142 is repeated for each length of the substrate 14 corresponding to a final package. This is normally also the case for the image to be printed on the substrate 14, i.e. the printing system 200 provides a periodic image to the substrate 14. Nevertheless, the printing system 200 may of course also be reprogrammed during the substrate feed such that dynamic images are produced.

Figure 3:
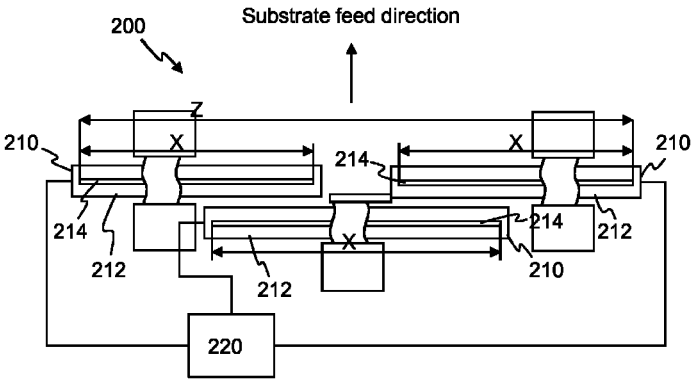
FIGS. 3 and 4 are schematic views of the printing system shown in FIG. 2.

In FIG. 3, a more detailed view of the printing system 200 is shown. Each printer unit 210 includes a housing 212 and an array of printing nozzles 214. Preferably the housing 212 is secured to supports of the printer 10 such that the printer unit 210 is aligned with the substrate 14, both laterally and vertically. The array of nozzles 214 has a lateral elongation and a maximum printing width X.

Each printer unit 210 is further connected to a controller 220 which is capable of storing a digital representation of the image to be printed, as well as being capable of controlling the individual nozzles of the printer unit 210. Hence, if a particular image is to be printed requiring only a certain number of nozzles to be activated, the controller 220 will transmit a signal to that particular printer unit 210 corresponding to the activation of that particular nozzles.

Since the printing units 210 are provided in an overlapping arrangement, the total maximum printing width Z of the printing system 200 is somewhat less than three times the maximum printing width X of each printer unit 210. For example, if the maximum printing width X of each printer unit 210 is 600 mm, and the total substrate width is 1600 mm, each overlap may be 100 mm.

However, if two adjacent printer units 210 should print parts of the same image, i.e. on the same web of the substrate 14, it is necessary to stitch the different printed parts to each other. Stitching is well known within digital printing and requires a complex algorithm and a feedback loop in order to create a seamless image. Since the width of the printer units 210 is relatively large, e.g. around 600 mm, any misalignment of the printer units 210 either vertically or laterally will cause visual defects in the image at the area where the printer units 210 overlap.

According to the embodiments described so far, and as will be further elucidated below, this problem may be solved by utilizing the non-printed areas 142 provided between the webs 142 for controlling the actual printing widths of the printer units 210.

Figure 4:
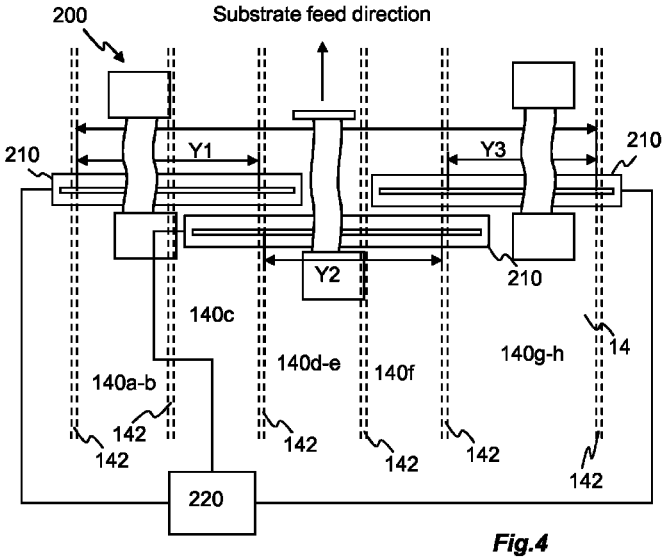

In FIG. 4, the printing system 200 of FIGS. 2 and 3 is shown relative the moving substrate 14. The controller 220 is here configured to set an actual printing width Y of each printer unit 210, wherein the actual printing width Y is less than the maximum printing width X of each printer unit 210.

Hence, the controller 220 serves two purposes namely i) to control the individual nozzles of the printer units for providing the desired image on the substrate, and ii) to control the actual printing width Y of the printer units 210. For these purposes the controller 220 may be divided into two or more controllers having internal or external digital memories connected to it. Further, the controller 220 may be connected to the printer units 210 either directly, by means of cables, or indirectly via radio frequency or e.g. the internet.

For determining the actual printing width Y of each printer unit 210 the controller 220 has an input channel receiving information about the substrate 14 to be printed, as well as the position and dimensions of the webs 140 and the non-printed areas 142. The controller 220 may thus have a coordinate system internally stored, wherein the positions of the substrate 14 as well as the positions of the printer units 210 are represented in said coordinate system.

Starting with the leftmost printer unit 210, its actual printing width Y1 is set as a part of the maximum printing width X. The controller 220 receives information that the left end of the substrate 14 is provided with an area 142 not to be printed, whereby the start position of the lateral elongation of the first printer unit 210 is set as the position where the non-printed area 142 ends. When moving laterally to the right of the substrate 14 a number of webs 140 may pass, until a non-printed area 142 is present at a position where two adjacent printer units 210 overlap. The controller thus sets an end position of the printing width of the first printer unit at the position, i.e. the first position, where the non-printed area 142, present at the printer unit overlap, begins. Hence, the part of the lateral elongation of the printer unit 210 being arranged distally of the start position and the end position, respectively, is set as non-active by the controller 220. The first printer unit 210 thus prints on webs 140*a-c* in FIG. 4.

The actual printing width Y2 of the center printer unit 210 is determined and set accordingly, such as the start position is set as the rightmost end of the non-printed area 142, i.e. a second position, that ends the actual printing width Y1 of the first printer unit 210. The end position of the actual printing width Y2 of the center printer unit 210 is set as the start position of a non-printed area being arranged laterally within the overlap between the center printer unit 210 and the rightmost printer unit 210. Hence, the center printer unit 210 is controlled to print on webs 140*d-f*.

The rightmost printer unit 210 is controlled in the same manner as the leftmost printer unit 210 and the center printer unit 210. In case where the rightmost end of the substrate 14 is provided with a non-printed area 142, the end position of the actual printing width Y3 is set accordingly.

The concept described above, i.e. to control the actual printing widths of separate but overlapping printer units 210 such that the image overlaps occurs only at areas not to be printed reduces the need for complex algorithms and extreme hardware alignment.

In certain embodiments the position and dimensions of the webs 140 and/or the non-printed areas 142 change dynamically while the substrate is running through the printer. Due to real time software of the controller 220 such situations may be successfully handled in the same manner as described above since the actual printing width of the different printer units 210 may be determined and set immediately on demand from the controller. Hence, the system described above may be utilized in every situation where two or more printer units are provide to print an image, either static or dynamic, on a substrate having at least two webs 140 being defined on each side of an area not to be printed, where said non-printed area is laterally located within the overlap between the printer units. Hence, the system described above may be expanded for printing systems including four or more overlapping printer units.

Although specific embodiments have been described it should be appreciated that various modifications may be made to the printing systems without departing from the scope as defined in the accompanying claims.

The invention claimed is:

1. A printing system for printing a repeated pattern of esthetical and/or informative character on a substrate including a plurality of parallel webs, comprising at least two overlapping non-impact printer units, each of which having a lateral elongation defining a maximum printing width, and a controller connected to each one of said printer units and configured to set an actual printing width extending between a start position and an end position of said lateral elongation, wherein said controller is configured to determine said actual printing width by receiving the lateral position of a non-printed area defined by the interface between two adjacent webs of the substrate and located laterally somewhere in the overlap between two printer units, such that the end position of a first printer unit and the start position of an overlapping printer unit is located within the non-printed area.

2. The printing unit according to claim 1, wherein the controller is configured to receive the lateral positions of a plurality of non-printed areas, and further to select the lateral position of a single non-printed area being located somewhere in the overlap between two printer units.

3. The printing system according to claim 1, wherein the lateral position of the non-printed area received by the controller is represented by a lateral distance extending from a first position and a second position, and wherein the end position of the first printer unit corresponds to the first position of the non-printed area, and wherein the start position of the overlapping printer unit corresponds to the second position of the non-printed area.

4. The printing system according to claim 1, wherein the maximum printing width of each printer unit is less than 1000 mm, and wherein the total printing width of the printing system is above 1000 mm.

5. The printing system according to claim 1, wherein the width of each web of the substrate is between 100 and 400 mm, and wherein the width of the non-printed area is between 5 and 50 mm.

6. The printing system according to claim 1, wherein each printer unit is an inkjet printer.

7. The printing system according to claim 1, wherein the substrate is roll fed.

8. The printing system according to claim 1, wherein the substrate is a carton based material for later converting into a liquid food packaging material.

9. A printer, comprising a plurality of printing systems according to claim 1 arranged in series along a processing path of the printable substrate, wherein each printing system is configured to print a specific color and/or part of the repeated pattern on the printable substrate.

10. The printer of claim 9, wherein each web of the printable substrate may be associated with a unique image to be printed, and wherein the printing systems is programmed to print the unique image on the corresponding web.

11. A method for providing a printing system configured to apply a repeated pattern of esthetical and/or informative character on a substrate including a plurality of parallel webs, comprising:

providing at least two non-impact printer units in an overlapping arrangement, each of which having a lateral elongation defining a maximum printing width, and connecting a controller to each one of said printer units for determining an actual printing width of each one of said printer units, said actual printing width is extending between a start position and an end position of said lateral elongation, by i) receiving the lateral position of a non-printed area defined by the interface between two adjacent webs of the substrate and located laterally somewhere in the overlap between two printer units, and ii) determining the actual printing width of each one of the printer units such that the end position of a first printer unit and the start position of an overlapping printer unit is located within said non-printed area.

12. A printing system for printing a repeated pattern of esthetical and/or informative character on a substrate which extends along a longitudinal direction and includes a plurality of parallel webs arranged side-by-side in a lateral direction, the printing system comprising:

first and second non-impact printer units which overlap one another in the lateral direction, the first and second non-impact printer units each possessing a lateral elongation in the lateral direction defining a maximum printing width of the respective printer unit, the first and second printing units each including an array of printing nozzles arranged in a respective housing;

a controller connected to each of the first and second non-impact printer units and configured to set an actual printing width extending between a start position and an end position of the lateral elongation; and the controller being configured to determine the actual printing width by receiving a lateral position of a non-printed area defined by an interface between two adjacent webs of the substrate and located laterally in the overlap between the first and second printer units such that the end position of the first printer unit and the start position of the overlapping second printer unit are located within the non-printed area.

* * * * *